US010815619B2

(12) United States Patent
Jannetyinen et al.

(10) Patent No.: US 10,815,619 B2
(45) Date of Patent: Oct. 27, 2020

(54) PRESS BELT, AN ARRANGEMENT IN A LONG NIP AND A METHOD OF MANUFACTURING A PRESS BELT

(71) Applicant: Valmet Technologies Oy, Espoo (FI)

(72) Inventors: Jari Jannetyinen, Sastamala (FI); Petteri Halme, Espoo (FI); Jori Onnela, Jyvaskyla (FI)

(73) Assignee: VALMET TECHNOLOGIES OY, Espoo (FI)

( * ) Notice: Subject to any disclaimer, the term of this patent is extended or adjusted under 35 U.S.C. 154(b) by 182 days.

(21) Appl. No.: 16/066,955

(22) PCT Filed: Dec. 28, 2016

(86) PCT No.: PCT/FI2016/050932
§ 371 (c)(1),
(2) Date: Jun. 28, 2018

(87) PCT Pub. No.: WO2017/115013
PCT Pub. Date: Jul. 6, 2017

(65) Prior Publication Data

US 2019/0040580 A1 Feb. 7, 2019

(30) Foreign Application Priority Data

Dec. 30, 2015 (FI) ..... 20156030

(51) Int. Cl.
*D21F 3/02* (2006.01)
*D21F 3/04* (2006.01)

(52) U.S. Cl.
CPC ..... *D21F 3/0227* (2013.01); *D21F 3/0236* (2013.01); *D21F 3/045* (2013.01)

(58) Field of Classification Search
CPC .... D21F 3/0209; D21F 3/0218; D21F 3/0227; D21F 3/0236; D21F 3/0245; D21F 3/04; D21F 3/045; D21G 1/0066
USPC ..... 162/358.3, 358.4, 901
See application file for complete search history.

(56) References Cited

U.S. PATENT DOCUMENTS

| | | | |
|---|---|---|---|
| 7,326,321 | B2 | 2/2008 | Hikida |
| 7,384,516 | B2 | 6/2008 | Fitzpatrick et al. |
| 2005/0145360 | A1 | 7/2005 | Hikida |
| 2013/0269895 | A1 | 10/2013 | Riihioja |

FOREIGN PATENT DOCUMENTS

| | | | | |
|---|---|---|---|---|
| DE | 4411621 | | 10/1995 | |
| DE | 4445472 | | 6/1996 | |
| DE | 19905515 | | 8/2000 | |
| DE | 10353270 | * | 6/2005 | ..... D21F 3/02 |
| EP | 0886004 | | 12/1998 | |
| EP | 1382737 | | 1/2004 | |

* cited by examiner

*Primary Examiner* — Eric Hug
(74) *Attorney, Agent, or Firm* — Leason Ellis LLP

(57) ABSTRACT

The invention relates to a press belt for a shoe press. A press belt (5) is an endless loop made of elastomeric material and its outer surface (11) is provided with several grooves (13) to remove water. On the outer surface (11) of the press belt, there is at least one section where the depths (GD) of adjacent drain grooves, from the outer surface, change constantly. The invention also relates to an arrangement in a long nip and to a method of manufacturing a press belt.

2 Claims, 6 Drawing Sheets

PRESS BELT, AN ARRANGEMENT IN A LONG NIP AND A METHOD OF MANUFACTURING A PRESS BELT

CROSS-REFERENCE TO RELATED PATENT APPLICATIONS

This application is a U.S. National Phase Application under 35 U.S.C. § 371 of International Patent Application No. PCT/FI2016/050932, filed Dec. 28, 2016, which claims the priority of Finnish Application No. 20156030, filed Dec. 30, 2015, each of which is incorporated by reference as if expressly set forth in its entirety herein.

BACKGROUND OF THE INVENTION

The invention relates to a press belt shaped like an endless loop and designed for a shoe press of a press section. A basic structure of the press belt comprises an elastomeric frame, and several parallel drain grooves are provided on the outer surface of the press belt.

The invention also relates to an arrangement in a long nip of a press section, said arrangement comprising at least an endless press belt and a backup roll. The invention also relates to a method of manufacturing press belts.

The field of the invention is described in greater detail in the preambles of the independent claims of the application.

Shoe presses are used in pulp, board and paper machines for removing water from a fibre web. The surface of the press belt facing the fibre web can be provided with grooves to improve water removal. In current grooved press belts, however, durability problems have been detected.

BRIEF DESCRIPTION OF THE INVENTION

The object of the present invention is to provide a novel and improved press belt, an arrangement in a long nip and a method of manufacturing press belts.

The press belt of the invention is characterised by what is presented in the characterising section of the first independent device claim of the application.

The arrangement of the invention is characterised by what is presented in the characterising section of the second independent device claim of the application.

The method of the invention is characterised by what is presented in the characterising section of the independent method claim of the application.

The idea of the solution presented is that there are several parallel drain grooves on the outer surface of the press belt, i.e. on the surface facing a web belt to be dried. The drain grooves are in the longitudinal or machine direction of the press belt. When the press belt is examined in a crosswise direction, it comprises drain grooves of varying depths. In the crosswise direction of the press belt, there are one or more sections where the depths of adjacent drain grooves, from the outer surface, change constantly. In other words, there is no stepwise or other sudden change between two adjacent drain grooves in said section, but the change in groove depths can be described as being streamlined or smooth.

An advantage of the solution presented is that as the depths of the drain grooves change constantly in the section examined, the structure of the press belt does not have a discontinuity point, generated by a stepwise change, that could initiate structural damage in the press belt. Further, the solution enables stepless adjustment of the water-removal capacity of the press belt in the section examined.

The idea of an embodiment is that there is at least one section in the crosswise direction of a press belt where the depths of adjacent drain grooves, from the outer surface, decrease towards the outermost edge of the press belt. The groove depth is thus greatest in the middle and smallest on the edges.

The idea of an embodiment is that there is at least one section in the crosswise direction of a press belt where the depths of adjacent drain grooves, from the outer surface, change linearly and decrease towards the outermost edge of the press belt.

The idea of an embodiment is that there is at least one section in the crosswise direction of a press belt where the depths of adjacent drain grooves, from the outer surface, change according to a mathematical model and decrease towards the outermost edge of the press belt. The groove depth can thus change, for example, in accordance with a curved profile line.

The idea of an embodiment is that the free volumes of said drain grooves, whose depths change, are different, one reason for this being that the depths of the drain grooves are different. Also, the cross-sectional profile and free surface area of the drain grooves may change as the groove depth changes, whereby the profile change, as well as the depth change, will affect the free volume of the drain grooves.

The idea of an embodiment is that said drain grooves, whose depths change, are equal in width, whereby adjacent drain grooves have different free volumes with respect to each other on account of their different groove depths.

The idea of an embodiment is that the largest widths of said drain grooves, whose depths change, are different, whereby adjacent drain grooves have different free volumes with respect to each other on account of both different depths and a larger width. The drain grooves may be different in shape in said section. The original cross-sectional shape of the drain grooves after the grooving may resemble an isosceles triangle with a cut corner, for example, whereby grinding of the outer surface of the press belt will change the shape and dimensions of the drain grooves as material is removed from the outer surface.

The idea of an embodiment is that a press belt, examined in a crosswise direction, comprises three parallel and longitudinal sections, i.e. a first edge section, a second edge section or a middle section in between. In the middle section, adjacent drain grooves may be equal in depth, and in the edge sections, the groove depths may vary. Namely, in both edge sections, the depths of the drain grooves may decrease from said middle section towards the outermost edge of the press belt. In other words, the standard grooves of the middle section will change towards the most shallow grooves.

The idea of an embodiment is that the outer surface of the press belt is cambered, whereby its shape is curved when examined in a crosswise direction. The press belt is thus thicker in the middle compared to the edges. The press belt is then said to be positively cambered.

The idea of an embodiment is that the outer surface of a press belt is cambered in such a way that it comprises at least one curved section. The curved shape of the press belt is achieved by grinding the outer surface of the frame after casting and the formation of drain grooves.

The idea of an embodiment is that the bottoms of drain grooves are at an equal distance from the inner surface of the press belt.

The idea of an embodiment is that the bottoms of the drain grooves are at different distances from the inner surface of the press belt.

The idea of an embodiment is that an arrangement in a long nip of a press section comprises at least a press belt and one or more press rolls or backup rolls. A fibre web to be treated can be led to a long nip between the press belt and a backup roll, supported by one or more paper machine fabrics, such as a press felt or the like. The outer surface of the press belt may be curved in a crosswise direction such that it is thicker in the middle than on the edges. The press belt is thus positively cambered. Correspondingly, the backup roll has a larger outer diameter in the longitudinal middle point than in its end sections, whereby the backup roll is also positively cambered. Furthermore, the outer surface of the press belt comprises several adjacent drain grooves. The drain grooves are arranged in such a way that in the crosswise direction of the press belt there is at least one section where the depths of adjacent drain grooves, from the outer surface, change constantly. Consequently, the groove depth is not constant in this section, nor does it change stepwise or by jumps. When the press belt is provided with positive cambering, the middle section has a larger outer diameter than the edge sections, in exactly the same way as the middle section of the cambered backup roll included in the arrangement has a larger outer diameter than its end sections have. As the press belt and backup roll rotate during operation, the outer surfaces of their middle sections, which have a larger diameter, have similar circumferential velocities, and no speed difference is generated between these surfaces. Furthermore, the circumferential velocities of the edge sections correspond to each other. In other words, on account of the positive cambering, the crosswise sections of the press belt and backup roll essentially have the same velocities in their same crosswise sections. By hindering velocity differences, it is possible to avoid wear of the press belt and torsional load directed at the structure.

The idea of an embodiment is that the outer surface of the frame of a press belt is provided with several drain grooves. After the grooving, the outer surface of the press belt is finalized by grinding. During grinding, the outer surface of the press belt is also cambered, whereby the depths of the drain grooves on the outer surface of the press belt will change constantly in at least one crosswise section of the press belt.

The idea of an embodiment is that the outer surface of a press belt is cambered and that drain grooves are not created until the surface has been cambered. The drain grooves will be made in such a way that the depths of adjacent grooves change constantly over the entire width of the usage area of the press belt or, alternatively, the press belt comprises two or more sections, examined in a crosswise direction, where the groove depth changes steplessly. The cambering can be carried out by grinding, for example, and the drain grooves can be made on the cambered surface with a chipping tool, such as a rotating end mill, a disc cutter or a corresponding other cutter, grinding wheel or grinding element, or with another corresponding blade. When grooving is not done until after the grinding or a corresponding cambering step, the position of the groove-cutting device or some other machining blade element in relation to the surface of the press belt needs to be affected, for the provision of drain grooves of varying depths towards the inner part of the press belt. The grooves can be made, for example, with a numerically controlled automated machine tool that can make adjacent grooves whose depths vary. Furthermore, a tool whose profile changes depending on the machining depth can be used. The cross-sectional shapes and dimensions of the grooves, and thereby the surface areas and free volumes of the groove cross-sections, change in response to the machining depth.

The idea of an embodiment is that the outer surface of a press belt is left smooth, i.e. it will not be cambered. It can be grooved, however, in line with the principles presented in this application, i.e. in such a manner that the press belt comprises several adjacent drain grooves whose depths and free volumes change constantly in relation to one another as we examine one or more crosswise sections of the outer surface. In other words, a press belt like this comprises a planar surface with grooves whose depths change steplessly.

The idea of an embodiment is that the drain grooves are endless. Endless grooves are ideal for removing water in the nip.

The idea of an embodiment is that drain grooves are of the desired length. The grooves are thus not endless but have a beginning and an end.

The idea of an embodiment is that the outer surface of the press belt is only provided with several longitudinal, endless drain grooves and longitudinal necks between them. There are no other patterns or shapes on the outer surface.

The idea of an embodiment is that the outer surface of a press belt is ground to have a roughness of Ra=less than 10 μm, examined in the machine direction MD. Ra is less than 2.6 μm, which is particularly advantageous.

The idea of an embodiment is that at least one outer edge of the press belt is provided with a mounting section crosswisely protruding from the water removal area of the press belt and allowing the press belt to be mounted on a press device. An MD mounting section like this may be provided on both longitudinal edges of the press belt.

The idea of an embodiment is that a press belt and a backup roll are positively cambered.

The idea of an embodiment is that the cross-sectional shape of drain grooves resembles a triangle with a cut corner.

The idea of an embodiment is that the cross-section of drain grooves is essentially shaped like letter U.

The idea of an embodiment is that the cross-section of drain grooves is rectangular in shape.

The idea of an embodiment is that the cross-sectional profile of adjacent drain grooves changes constantly at the same time as their depth changes. The cross-section of the drain grooves differs from a rectangular shape. The cross-sectional profile of the drain grooves widens towards the outer surface.

The idea of an embodiment is that the depth of drain grooves changes constantly from the crosswise middle point of the press belt towards both edges.

The idea of an embodiment is that the outer surface of a press belt is evenly curved when examined in the crosswise direction.

The idea of an embodiment is that the outer surface of a press belt comprises a middle section of an even thickness and at least one edge section with a curved outer surface in the sections between the middle section and the outer edges.

The idea of an embodiment is that the cross-section of grooves is arranged to grow bigger towards the outer surface. The grooves may thus have an essentially V-shaped cross section or, alternative, an essentially U-shaped cross-section that widens upwards.

The idea of an embodiment is that the groove frequency on the outer surface of a press belt is essentially constant over the entire usage or pressing area. The crosswise distance between the centre lines of adjacent drain grooves thereby remains constant over the entire pressing area.

The above embodiments and their individual features can be combined to form the desired combinations.

BRIEF DESCRIPTION OF THE FIGURES

Some embodiments of the invention are described in greater detail in the accompanying drawings, in which.

For reasons of clarity, some embodiments of the invention are illustrated in the Figures in a simplified form. Similar parts are indicated in the figures by the same reference numbers.

DETAILED DESCRIPTION OF SOME EMBODIMENTS OF THE INVENTION

Figure 1:
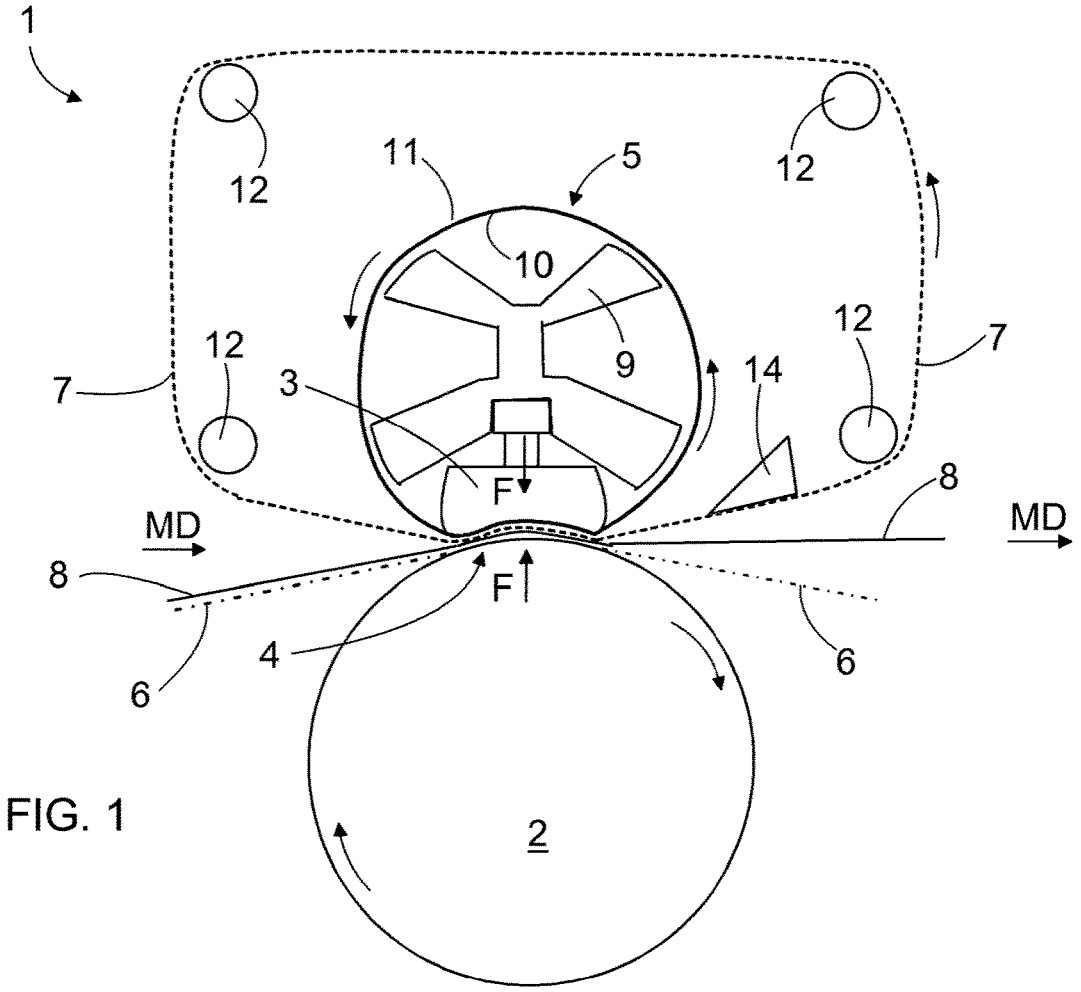
FIG. 1 is a schematic representation of the principle of a shoe press.

FIG. 1 shows a highly simplified view of a shoe press 1, which is a drying device typically used in drying a fibre web. The shoe press 1 comprises a press roll or backup roll 2 and a press shoe 3 with a pressing zone 4 between them, through which zone a press belt 5 is arranged to run in the machine direction MD, at least one paper fabric 6, 7 and a fibre web 8 to be dried. The press shoe 3 and backup roll 2 are pressed against each other by force F, whereby the press belt 5, paper machine fabric 6, 7 and fibre web 8 running between them are compressed. The press shoe 3 has a curved sliding surface facing the press roll 2, whereby an elongated contact area, i.e. a so-called long nip, is formed between the press shoe 3 and the backup roll 2. The press belt 5 may be arranged to run around the press shoe 3, supported by a suitable support member 9. An inner surface 10 of the press belt 5 slides against the sliding surface of the press shoe 3, and an outer surface 11 of the belt faces the fibre web 8. The fibre web 8 is guided to the pressing zone 4, typically supported by one or more paper machine fabrics, such as a press felt 7 or wire 6. The paper machine fabric 6, 7 is guided by guide rolls 12 or the like. In the solution of FIG. 1, the upper paper machine fabric may be a press felt 7 and the lower fabric may be a wire 6.

The outer surface 11 of the press belt 5 may comprise several grooves 13 for removal of water. When the fibre web 8 runs through the relatively long pressing zone 4 formed by the press roll 2 and the press shoe 3, water will be squeezed out. At least some water may run through the press felt 7 into drain grooves 13 made on the outer surface 11 of the press belt 5 and providing additional space for the draining water. The water volume that the pressed press felt 7 cannot receive may then drip into the water space provided by the press belt 5. Should the press belt 5 not provide any additional water space, the water may move towards the beginning of the pressing zone 4 and create running problems. Drain grooves 13 provided on the outer surface 11 of the press belt 5 prevent flooding and control water removal. One or more water collecting devices 14 or the like may be arranged in connection with the press felt 7 circulation path, whereby water can be removed from the press felt 7 before the felt returns to pressing zone 4.

It should be noted that the press belt according to the invention may also be used in other types of shoe presses. The idea of an embodiment is that the shoe press comprises a rotating press or backup roll against which a press shoe provided with a curved surface is pressed, which forms an elongated nip. Guided by guide rolls or the like, a separate press belt may be run to the space between the press roll and the press shoe. Further, a fibre web, supported by a paper machine fabric, is run to the pressing zone. Furthermore, the separate press belt may be arranged on top of the press roll and the press shoe may be pressed towards the press belt forming the outer surface of the press roll. A common feature of the above embodiments is that the press belt is always a separately manufactured component shaped like an endless loop, which is or can be arranged in a shoe press in such a way that it runs through a long nip between at least one roll and a press shoe.

Figure 2:
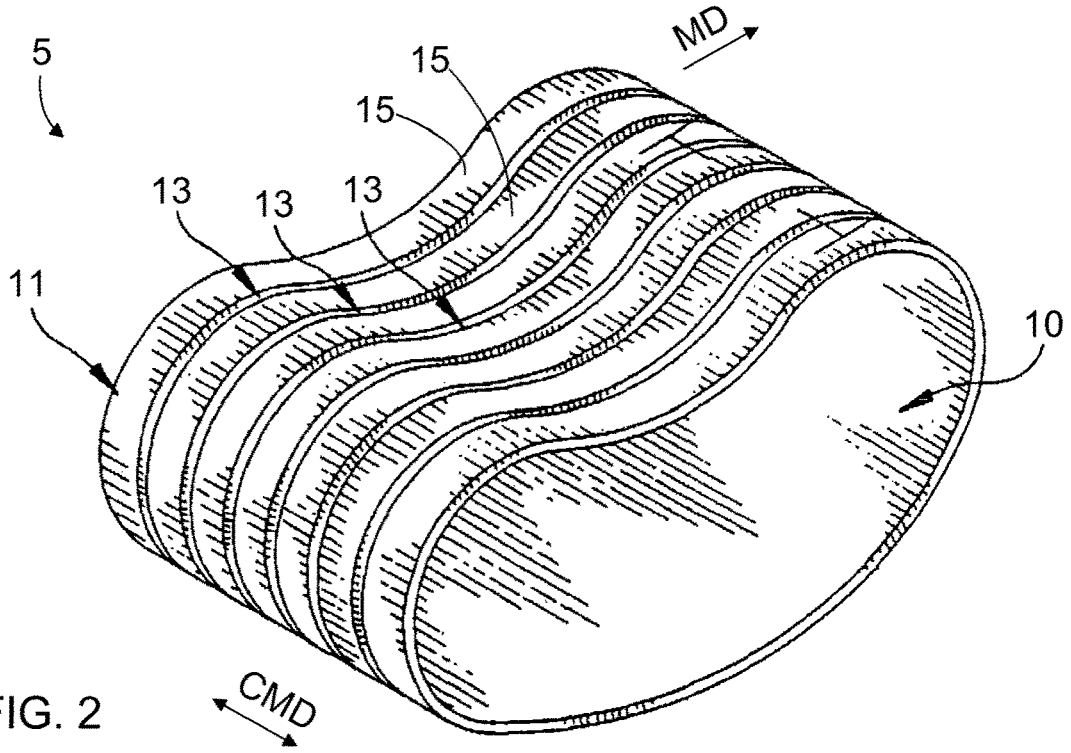
FIG. 2 is a schematic and perspective view of a press belt shaped like a closed loop.

FIG. 2 shows a press belt 5 shaped like an endless loop, comprising an inner surface 10 and an outer surface 11. The press belt 5 is arranged in a shoe press 1 in such a way that its outer surface (11) faces a fibre web 8. The outer surface 11 comprises several parallel drain grooves 13. The drain grooves 13 may be endless and they may be arranged substantially in the machine direction MD. Between adjacent drain grooves 13, there is a longitudinal neck 15. The drain grooves 13 may go around the press belt 5 or they may be continuous spiral grooves.

Figure 3:
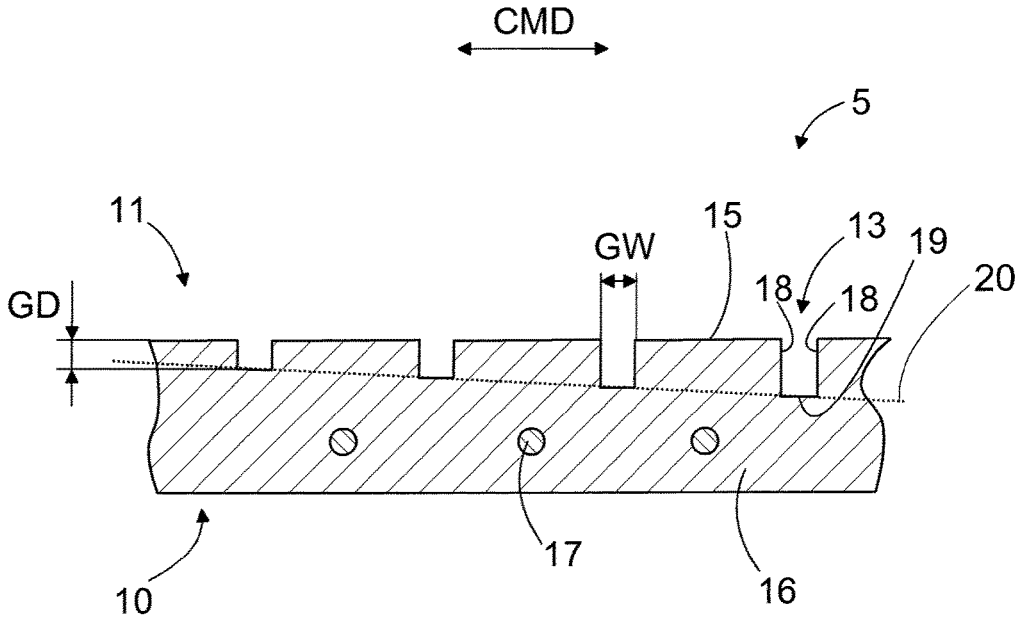
FIG. 3 is a schematic view of the cross-section of a press belt examined in the longitudinal, or machine direction.

FIG. 3 illustrates a cross-section of a press belt 5, seen in the machine direction MD. The press belt 5 comprises an elastic frame 16 having sufficient elasticity and ability to return to its original shape after pressing. The frame 16 may be mainly of elastomeric material, such as rubber fit for purpose, or it may be made of a polymer, such as polyurethane. Further, the press belt 5 may have a support structure potentially comprising several support yarns 17 arranged in one, two or more layers inside the frame 16. The yarn layers on top of each other may be separate or they may be tied together. An inner surface 10 of the press belt 5 may be substantially smooth. An outer surface 11 of the press belt 5, however, comprises several parallel drain grooves 13 with necks 15 between them. The drain grooves 13 are typically arranged in the machine direction MD.

The cross-section of the drain grooves 13 may be of a rectangular shape as illustrated in the figure, but they may also be substantially U-shaped or of the shape of a cut triangle. The groove 13 has side surfaces 18 and a bottom 19.

The section between the bottom 19 and the sides 18 may be rounded or bevelled to improve durability. Further, the greatest depth GD of each groove 13 is determined from the outer surface 11 to the deepest point of the bottom 19. The width GW of the grooves 13 in the figure is constant, but the groove depth GD, on the other hand, changes constantly. The bottoms 19 of the grooves are in a straight line 20, which clearly illustrates the continuously changing depths in the section examined. The grooves on the outer surface 11 may be made with a chipping tool, whose depth position will be set, for the duration of the machining, as required by each individual groove. In FIG. 3, the outer surface 11 of the press belt 5 is planar.

Figure 4:
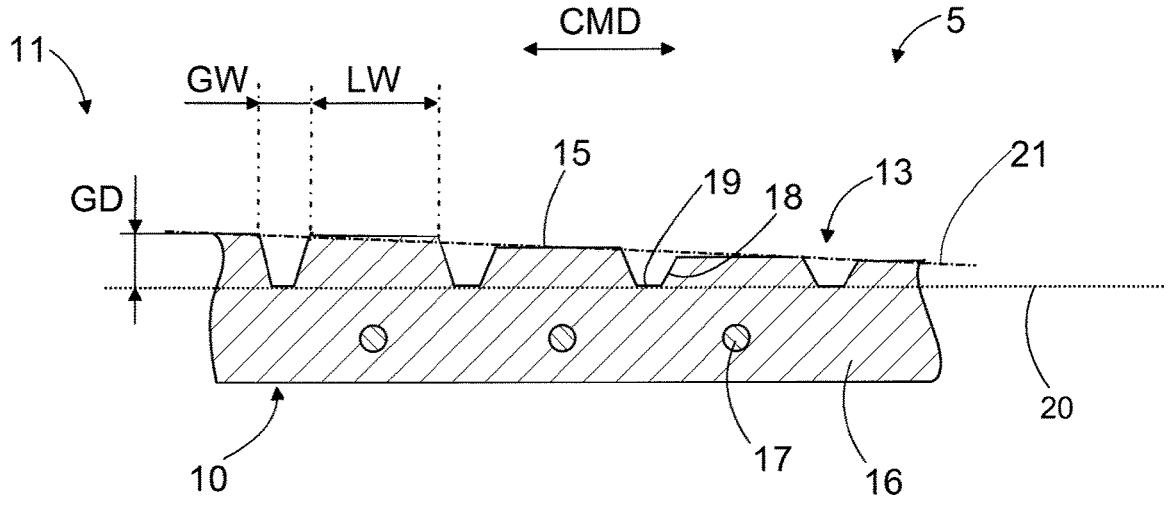
FIG. 4 is a schematic view of the cross-section of another press belt examined in the machine direction.

FIG. 4 shows a press belt 5 with a cambered outer surface 11, whereby the surface is curved. The curvature is illustrated, in an exaggerated manner, with a profile line 21. The outer surface 11 comprises drain grooves 13, whose bottoms 19 are at an equal distance from an inner surface 10. A broken line in the figure illustrates a plane 20 passing through the bottoms 19. The depth GD of the grooves 13 changes constantly, and so does the width LW of necks 15. Further, as the cross-sectional shape of the grooves 13 is that of a triangle with a cut corner and comprises bevelled side surfaces 18, the cross-sectional shape of the grooves 13 changes constantly.

FIGS. 5*a* to 8*b* show a highly simplified view of a press belt 5 seen from the machine direction. The contour of the press belt is exaggerated and, for the sake of clarity, cross-sectional lines and drain grooves have been left out. However, a line 20 passing through the bottoms of the drain grooves is shown to illustrate the grooves and their features.

Figure 5A:
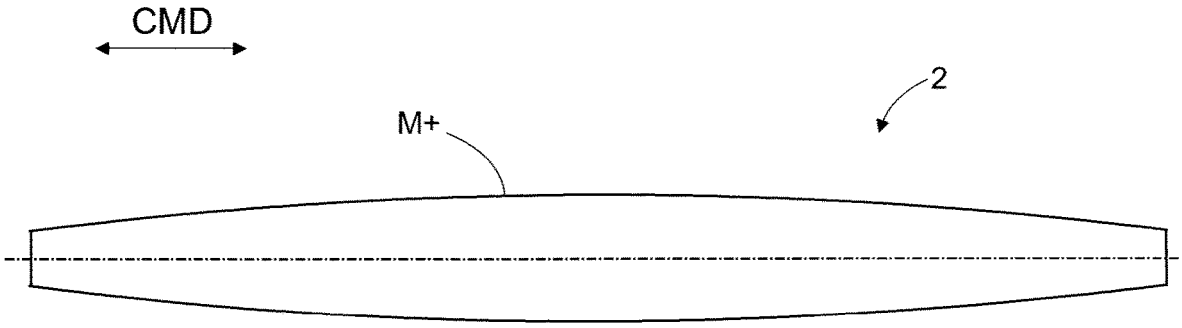
FIG. 5*a* is a schematic and a highly simplified view of a positively cambered backup roll.
Figure 5B:
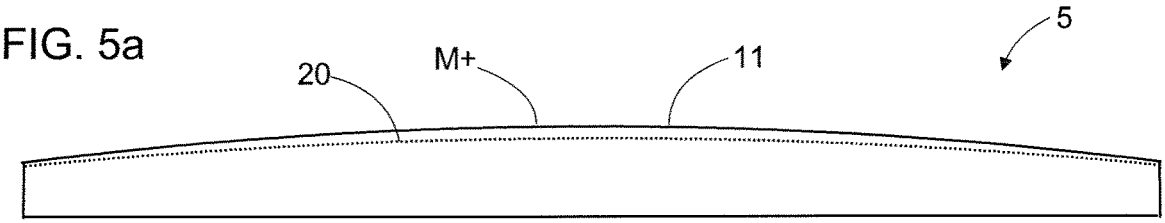
FIG. 5*b* shows a press belt whose surface facing the web has also been positively cambered.

FIG. 5*a* shows a simplified and an exaggeratedly reduced view of a backup roll 2 provided with positive cambering M+. FIG. 5*b* illustrates a press belt 5 whose outer surface 11 facing the web is also positively cambered M+. The arrangement thus comprises positively cambered M+ components 2 and 5 facing each other. FIG. 5*b* also illustrates a line 20 passing through the bottoms of the drain grooves, which line may be straight or a curved line illustrated in the figure.

Figure 6:
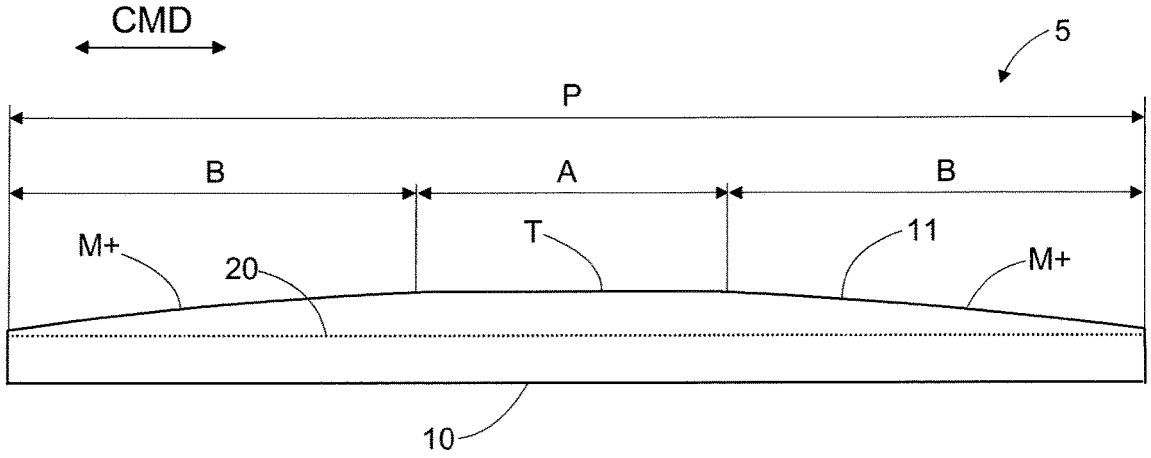
FIG. 6 is a schematic, machine-direction view of the profile of a partly cambered press belt, where the press belt comprises outermost curved edge sections and a planar middle section.

A press belt 5 of FIG. 6 comprises curved edge sections B in the pressing section P and a middle section A between them. The edge sections B are positively cambered M+ and the middle section has a planar surface T. The bottoms of all the grooves are in line 20. On account of the cambering of the edge sections B, the groove depth changes constantly in accordance with the curvature of the cambering.

Figure 7A:
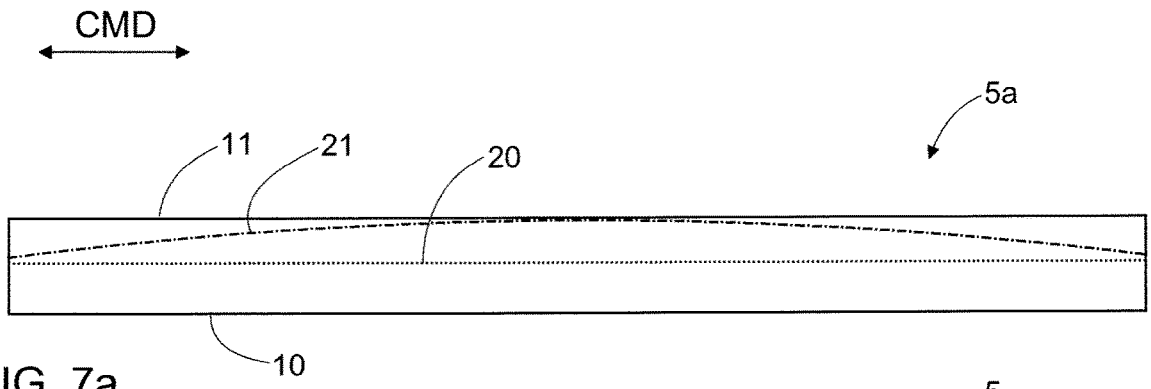
FIG. 7*a* is a schematic, machine-direction view of the profile of a grooved press belt blank.
Figure 7B:
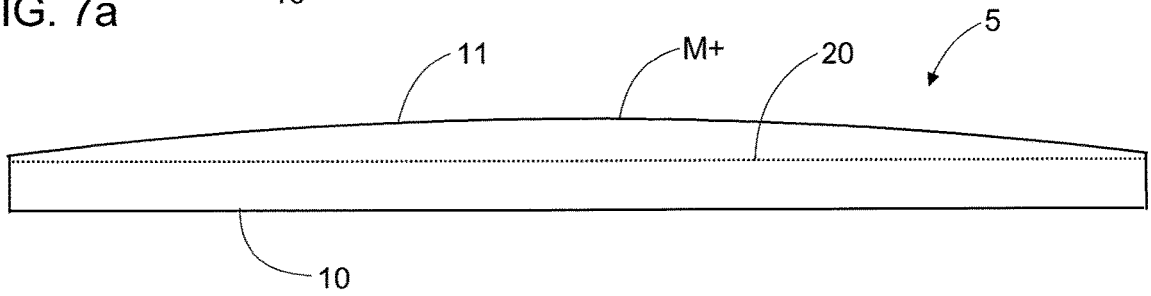
FIG. 7*b* illustrates a situation after cambering.

FIG. 7*a* shows a profile of a grooved press belt blank 5*a*, and FIG. 7*b* shows a finished press belt 5 when an outer surface 11 has been provided with positive cambering M+. In this embodiment, grooves of a standard depth are made first, and the outer surface will then be curved.

Figure 8A:
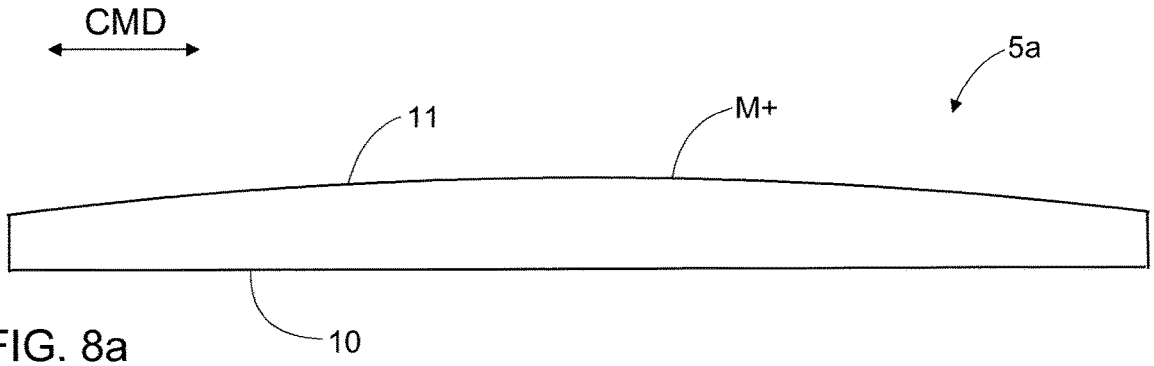
FIG. 8*a* is a schematic, machine-direction view of the profile of a cambered, ungrooved press belt blank.
Figure 8B:
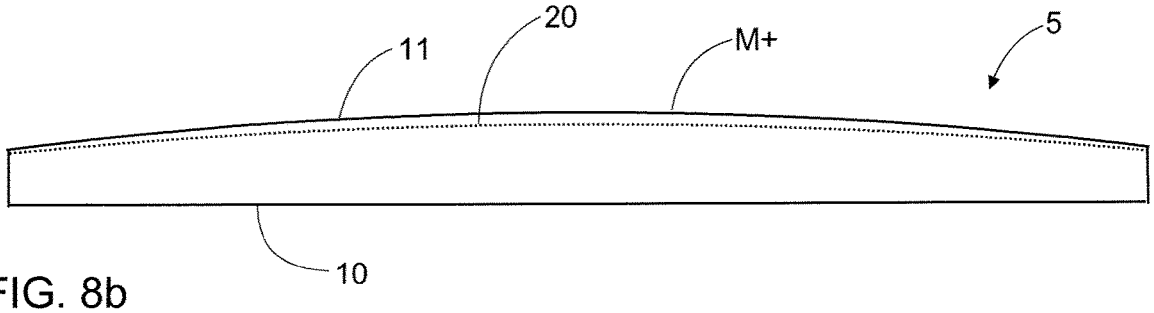
FIG. 8*b* illustrates a situation after grooving.

FIG. 8*a* shows a profile of a cambered, ungrooved press belt blank 5*a*, and FIG. 8*b* shows a finished press belt after grooving. In this embodiment, positive cambering M+ is performed first, and grooves of varying depths will then be made.

Figure 9:
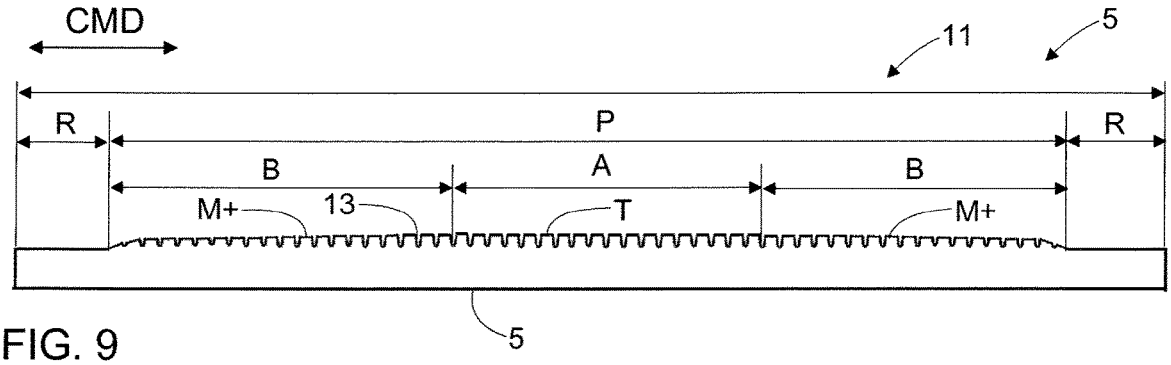
FIG. 9 is a schematic, machine-direction view of a cambered and grooved press belt, which comprises longitudinal mounting sections on the outermost edges.

FIG. 9 shows a cambered and grooved press belt 5 having longitudinal mounting sections R on the outermost edges outside the press section P. The middle section A may comprise a planar section T, and the edge sections B may be positively cambered M+.

Figure 10A:
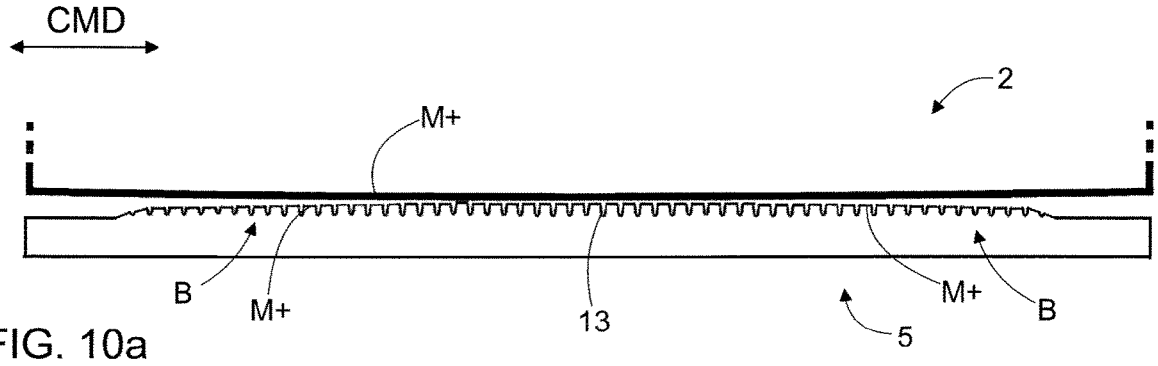
FIG. 10*a* is a schematic, machine-direction view of the press belt according to FIG. 9 before a long nip and pressing.
Figure 10B:
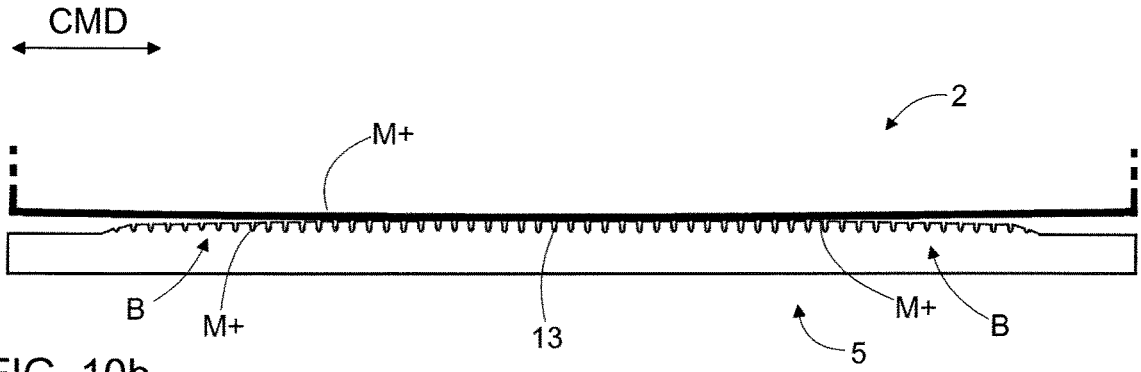
FIG. 10*b* illustrates the situation at the beginning of the long nip.
Figure 10C:
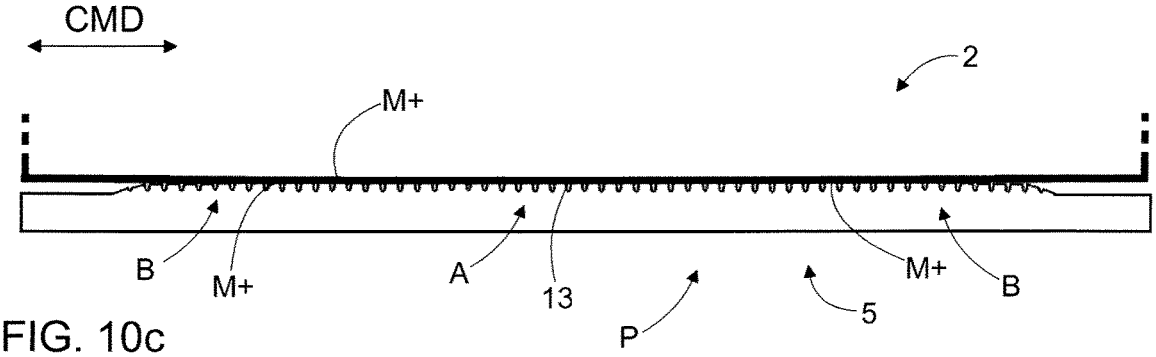
FIG. 10*c* illustrates the situation in the most heavily loaded area of the long nip.

FIGS. 10*a*-10*c* show a simplified arrangement in a long nip, without a fibre web and press felt between a press belt 5 and a backup roll 2. In addition, only part of the backup roll 2 is shown in the figure. FIG. 10*a* shows the press belt 5 according to FIG. 9 before it is compressed in the long nip. FIG. 10*b* illustrates a situation at the beginning of the long nip, whereas FIG. 10*c* illustrates a situation in the most heavily loaded area of the long nip. As shown in FIGS. 10*a* and 10*b*, before the press belt 5 is compressed, the drain grooves 13 are clearly deeper and larger in the middle section of the press belt 5 than on the edges. In FIG. 10*c*, on the other hand, the press belt structure is compressed, particularly in the middle section, on account of a positively cambered M+ backup roll 2, which puts most pressure on the middle section. As in the starting situation the grooves in the middle section of the press belt 5 have the largest free cross-sectional area, they are sufficiently large for water removal even after the structure has been compressed. The differences in the depths and water volumes of the grooves on the outer surface of the press belt will level out during the pressing on account of the cambered backup roll.

Figure 11:
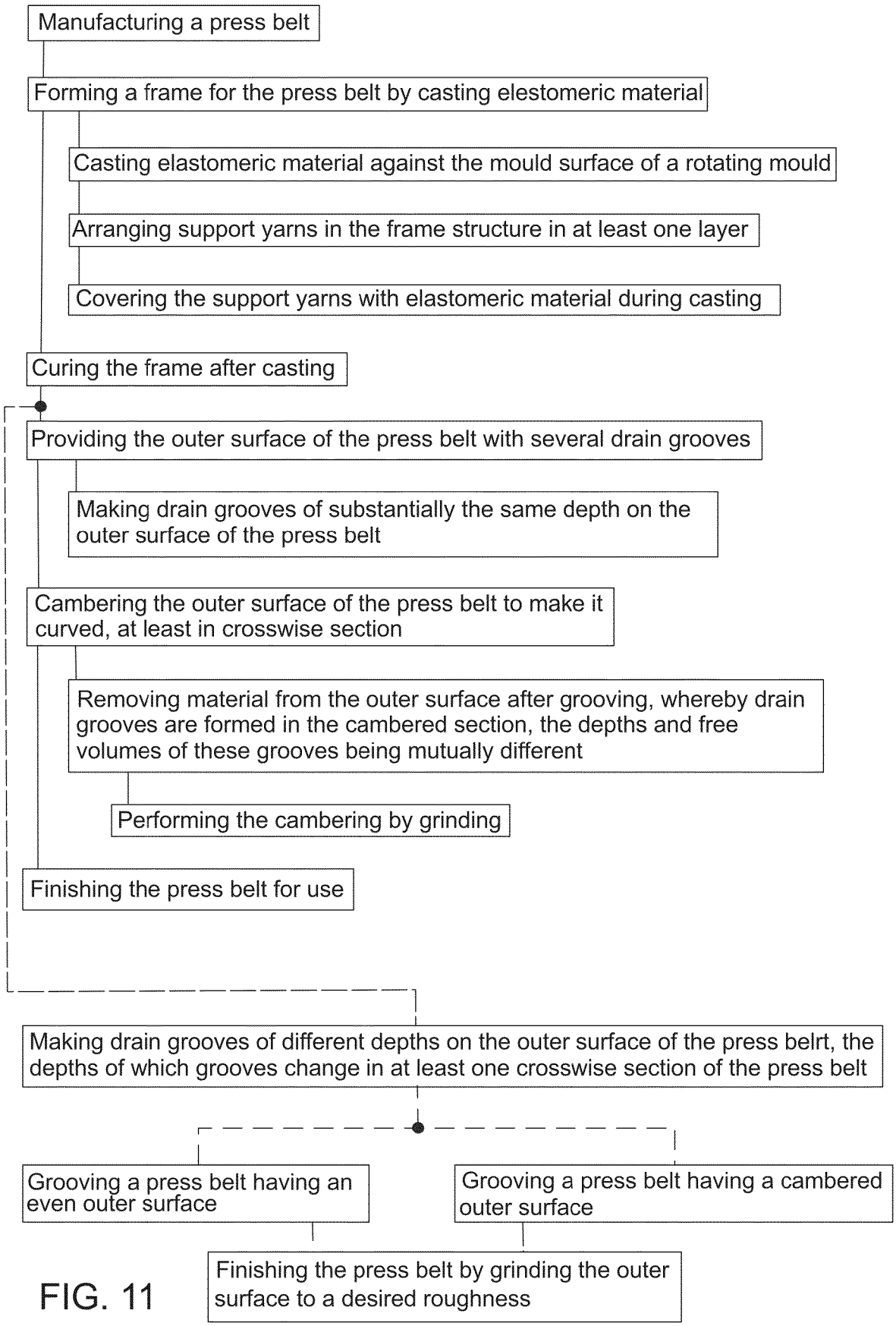
FIG. 11 is a schematic diagram of features relating to the manufacture of a press belt.

FIG. 11 shows a schematic diagram of features relating to the manufacture of a press belt and some alternative manufacturing methods. These details relating to the manufacture have been described earlier in this application, but they can be summarised by stating that a method of manufacturing a press belt comprises the following features: shaping a frame for a press belt by casting at least one elastomeric material against a mould surface of a rotating mould; providing the frame with several support yarns and covering them with elastomeric material during the casting; curing the frame; providing the outer surface of the frame with several drain grooves; finishing the outer surface of the press belt by grinding it after grooving; and cambering the outer surface of the press belt by grinding it after grooving, whereby the depths of the drain grooves on the outer surface of the press belt vary constantly in at least one crosswise section of the press belt.

Furthermore, calender presses, using which the surface of a web to be treated can be polished, are previously known. Such calender presses comprise a long nip with shoe and backup rolls. The backup roll of a calender press may be cambered and, similarly, the press felt used may also be cambered. The press belt may have been cambered taking account of the features disclosed in this application. However, the cambered press belt used in a calender press does not comprise drain grooves. In addition to a calender press, such ungrooved, cambered press belts can also be used in slow-speed board machines, pulp dryer machines or other slow-speed machines. The embodiments described in this paragraph are not in line with the independent claims of this application, as grooves are lacking.

In some cases, features disclosed in this application can be used as such, independently of other features. On the other hand, features disclosed in this application can be combined, if necessary, to form various combinations.

The drawings and their description are intended only to illustrate the idea of the invention. The details of the invention may vary within the scope of the claims.

The invention claimed is:

1. An arrangement in a long nip of a press section, comprising:

a press belt (5) and at least one backup roll (2), wherein an outer surface (11) of the press belt (5) is curved in the crosswise direction (CMD) in such a way that it is thicker in the middle than on the edges, whereby the press belt (5) is positively cambered (M+);

wherein the backup roll (2) has a larger outer diameter in the longitudinal middle point than in its end sections, whereby the backup roll (2) is also positively cambered (M+);

wherein several adjacent drain grooves (13) are arranged on the outer surface (11) of the press belt (5); and wherein in the crosswise direction (CMD) of the press belt (5), there is at least one section where the depths (GD) of adjacent drain grooves (13), from the outer surface (11), change constantly, decreasing towards the outer edge of the press belt (5,) and where bottoms (19) of the drain grooves (13) are at an equal distance from an inner surface (10) of the press belt (5).

2. A method of manufacturing a press belt by:

shaping a frame (16) for the press belt (5) by casting at least one elastomeric material against a mould surface of a rotating mould;

providing the frame (16) with several support yarns (17) and covering them with elastomeric material during the casting;

curing the frame (16);

providing an outer surface (11) of the frame (16) with several drain grooves (13); and finishing the outer surface (11) of the press belt (5) by grinding it after grooving;

cambering the outer surface (11) of the press belt (5) by grinding it after grooving, whereby the depths (GD) of the drain grooves (13) on the outer surface (11) of the press belt (5) change constantly in at least one cross-wise section (CMD) of the press belt (5), decreasing towards the outer edge of the press belt (5); and whereby bottoms (19) of the drain grooves (13) are at an equal distance from an inner surface (10) of the press belt (5).

* * * * *